US005577989A

United States Patent [19]

Neary

[11] Patent Number: 5,577,989

[45] Date of Patent: Nov. 26, 1996

[54] METHOD FOR FORMING CORRUGATED PAPER CONTAINER AND CONTAINER MADE THEREFROM

[75] Inventor: Robin P. Neary, Warren, N.J.

[73] Assignee: Newark Group Industries, Inc., Cranford, N.J.

[21] Appl. No.: 262,165

[22] Filed: Jun. 20, 1994

[51] Int. Cl.[6] ..... B31B 1/44

[52] U.S. Cl. ..... 493/169; 264/287; 493/902

[58] Field of Search ..... 493/167–174, 493/328, 330, 902; 264/322, 287, 343

[56] References Cited

U.S. PATENT DOCUMENTS

| | | | |
|---|---|---|---|
| 203,000 | 4/1878 | Crane | 264/322 |
| 221,234 | 11/1879 | Ingersoll | 264/322 |
| 464,628 | 12/1891 | Anderson | 493/171 |
| 1,314,192 | 8/1919 | Hill | 493/171 |
| 2,744,624 | 5/1956 | Hoogstoel et al. . | |
| 3,690,981 | 9/1972 | Di Frank et al. . | |
| 3,792,809 | 2/1974 | Schneider et al. . | |
| 3,938,727 | 2/1976 | Andersson . | |
| 4,637,811 | 1/1987 | Fortney . | |
| 4,930,681 | 6/1990 | Fultz et al. . | |
| 4,931,346 | 6/1990 | Nogueras Dardina . | |
| 5,096,650 | 3/1992 | Renna | 264/322 |
| 5,290,501 | 3/1994 | Klesius | 264/322 |
| 5,326,021 | 7/1994 | Farrell et al. . | |
| 5,358,174 | 10/1994 | Antczak et al. . | |

FOREIGN PATENT DOCUMENTS

| | | |
|---|---|---|
| WO92/09486 | 6/1992 | WIPO . |
| WO93/23294 | 11/1993 | WIPO . |

*Primary Examiner*—Jack W. Lavinder
*Attorney, Agent, or Firm*—Stroock & Stroock & Lavan

[57] ABSTRACT

A method for forming a corrugated paperboard container and a container made therefrom having a first layer of flat paperboard to which is attached a second layer of contoured paperboard, said contoured layer having a plurality of flutes, each said flute including a first flute tip and a second flute tip, the flute rise being substantially vertical at the midpoint between said flute tips, said forming method comprising, placing the corrugated paperboard into a stamping die, the stamping die having a male die and a female cavity shaped in the shape in which the paperboard is to be formed; pressing the paperboard between the die and the cavity to apply a pressure to the paperboard; applying heat to the paperboard simultaneously with said application of pressure; and removing said die from the cavity.

11 Claims, 2 Drawing Sheets

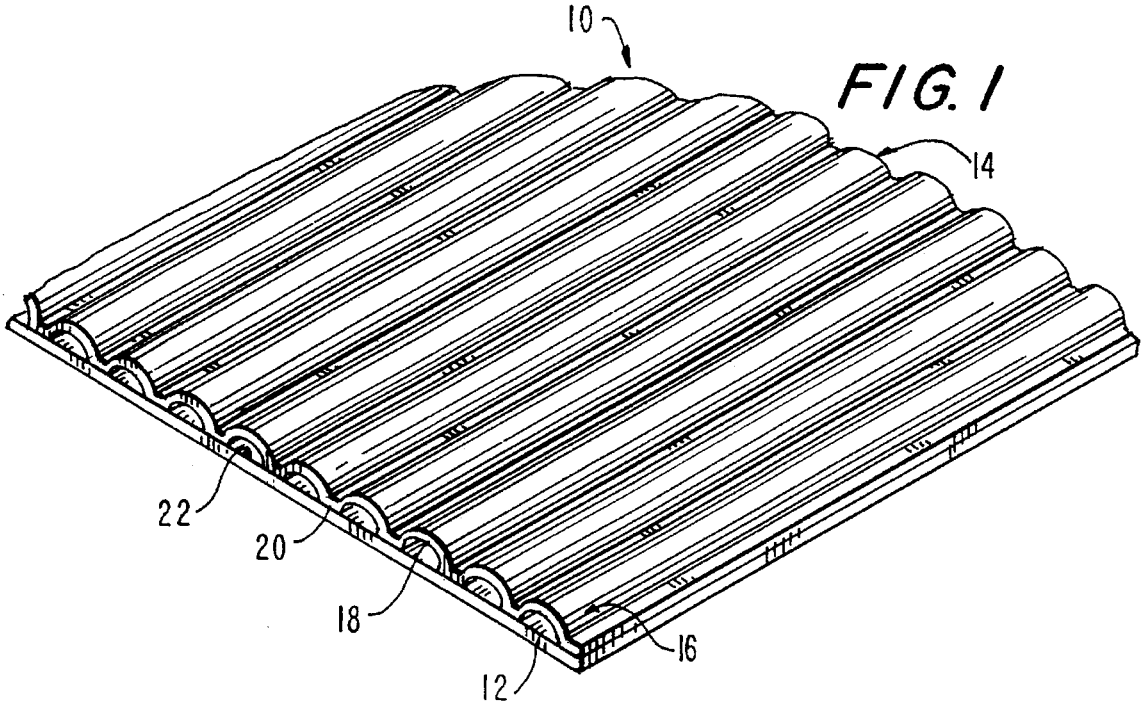
FIG. 1
FIG. 3
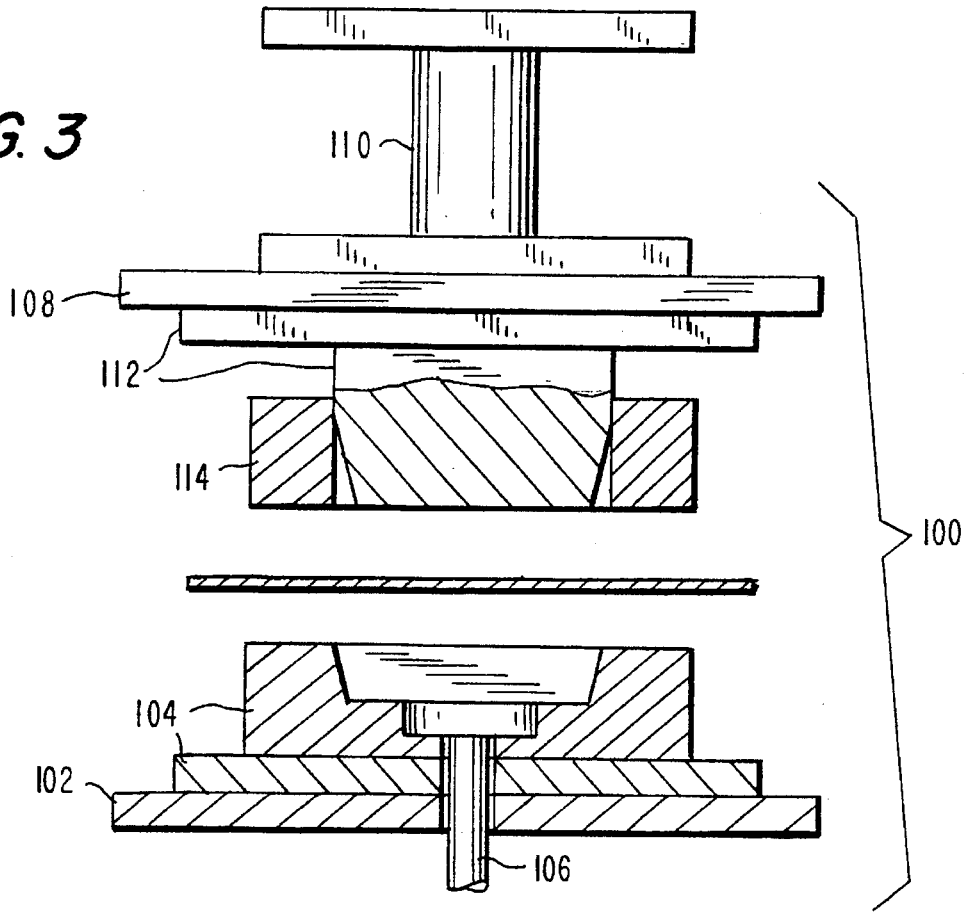

METHOD FOR FORMING CORRUGATED PAPER CONTAINER AND CONTAINER MADE THEREFROM

BACKGROUND OF THE INVENTION

The present invention relates to a method of forming corrugated paperboard containers, including food containers and food trays and, in particular, employing corrugated paperboard in a novel stamping process, which paperboard has an increased frequency of flutes in its internal layer, such that upon introducing the corrugated paperboard to the stamping process, the paperboard does not break apart and is capable of being molded to produce a satisfactory unitary structure.

Heretofore, to produce unitary paperboard containers without gluing, manufacturers have attempted to stamp certain types of corrugated paperboard, such as E-flute corrugated paperboard, and have been unable to create a satisfactory unitary construction. Efforts at stamping corrugated paperboard resulted in the paperboard breaking up during the stamping process and have failed to achieve a utilitarian molded unitary structure.

Accordingly, the use of corrugated paperboard for containers has been limited to an expensive multi-step manufacturing process in which the paperboard must first be printed, then die cut and then passed through complex box folding machinery. Accordingly, a corrugated paperboard that would permit pressing and forming (stamping) into a container and a method of pressing and forming corrugated paperboard container would be desirable.

SUMMARY OF THE INVENTION

Generally speaking, in accordance with the instant invention, a method of forming a unitary container from corrugated paperboard is provided. The method comprises introducing corrugated paperboard having an outer flat layer of paperboard and an internal contoured layer of paperboard having a high frequency, per linear meter of paperboard, of flutes formed from alternating upper and lower curved surfaces into a die press and pressing the paperboard between a die and a cavity to apply pressure to the paperboard. Applying heat to the paperboard simultaneously with the application of pressure.

Accordingly, it is an object of this invention to provide an improved method for forming a unitary container of corrugated paper.

Another object of the invention is to form a container from corrugated paper by stamping, without the need for a complex box folding machinery or the need for die cutting.

Yet another object of the invention is to form a unitary box from single face or single ply corrugated paper.

A further object of the invention is to provide a container made out of lighter, cheaper and recyclable materials.

Still another object of the invention to provide a method for forming complex shapes by pressing and forming paperboard.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 1 is a partial perspective view of the paperboard utilized in connection with the invention;

FIG. 3 is a sectional view of stamp used in connection with the method of the invention.

DETAILED DESCRIPTION OF THE PREFERRED EMBODIMENTS

Figure 2:
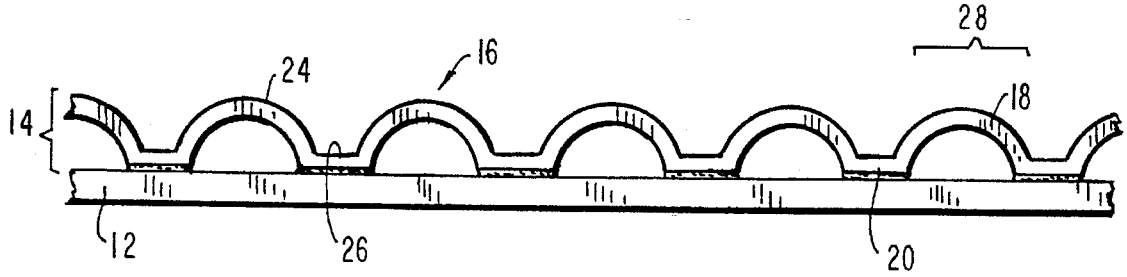
FIG. 2 is a front elevated view of the paperboard constructed in accordance with the invention.

An example of corrugated paper used to form applicant's box is disclosed in U.S. Pat. No. 4,931,346 which is incorporated herein by reference. Reference is made to FIGS. 1 and 2, wherein a paperboard, capable of being pressed and formed (stamped), generally indicated as 10, comprising two layers is depicted. An outer layer 12 is flat paperboard having a thickness in the range of 0.3 mm to 1.5 mm.

An internal layer, generally indicated as 14, of paperboard 10 is contoured, having a thickness in the range of 0.23 mm to 0.5 mm. The internal contoured layer 14 consists of flutes 16, each flute being formed by one of an alternating upper 18 or lower 20 curved surface. Internal layer 14 is glued to an inner surface 22 of the outer layer 12 along the lower curved surfaces 20. Gluing the lower curved surfaces 20 of the internal layer 14 to the inner surface 20 of the outer layer 12 allows for the formation of exposed ridges 24 and grooves 26 (FIG. 2) across the unattached surface of internal layer 14. Internal layer 14 has a high frequency (flutes/meter) of flutes 16 and a corresponding high frequency of ridges 24 on the exposed surface of internal layer 14 allowing the paperboard 10 to be pressed into a unitary structure.

One upper curved surface 18 and an alternating lower curved surface 20 make up one set of flutes 28. Each flute 16 has a height in the range of 0.9 mm to 1.2 mm or 0.035 inches to 0.047 inches, and sets of flutes 28 in the internal layer 14 have frequency within the range of 350–400 sets of flute 26 per linear meter of paperboard 10. In an exemplary embodiment, the number of sets of flutes is 375 per linear meter of paperboard, the flute repeat length to flute height ratio is 2.6 or less, and the corresponding number of ridges on the top surface of the internal layer is 6 to 12 ridges per inch.

In producing the stampable paperboard 10, internal contoured layer 14 has glue applied to the lower curved surfaces 20. Outer layer 12 and internal layer 14 are passed through rollers under a sufficient pressure to compress the two layers together to adhere them. As a result, lower curved surfaces 20 adhere to inner surface 22 of the outer layer 12 and the pressure causes the lower curved surfaces 24 to imbed and become indented into inner surface 20 of outer layer 12 by at least 0.1 mm (0.004 inches). In the preferred embodiment, the amount of indent (or imbedding) is 0.2 mm (0.008"). The high frequency of flutes 16 per inch, and, hence, the corresponding increased number of ridges 24 across the unattached surface of the internal layer 14, causes the flats (between curves 18 and 20) in each of the flute sets 28 to become more vertical and this adds strength during compression so that the paperboard can be pressed and formed.

Accordingly, by increasing the number of flutes 16, and hence the number of ridges 24, the ability of the corrugated paperboard to be pressed and formed consequently increases.

The flutes in the stampable paperboard have a higher frequency and higher amplitude when compared with other fluted paper. This maximizes the ratio of flute repeat length to flute height. Because of the more vertical flute rise at the midpoint between flute tips there is a greater rate of change of height over distance so that for a given height of flute rise, the corrugated paperboard will have a smaller repeat ratio when compared to E-flute or F-flute, by way of example, and for a given repeat ratio the described paperboard will have a higher amplitude than E-flute or F-flute corrugated paperboard. In the preferred embodiment the stampable corrugated paperboard has a flute repeat length to flute height ratio of 2.6, whereas in E-flute or F-flute, the flute repeat length to flute height ratio is 2.8.

It is the high frequency of flutes per inch in the corrugation that specifically allows the paperboard to be molded by the dye pressing method described in detail below. Unlike attempting to mold corrugated paperboard of the prior art, which paperboard does not have such high density fluting in the corrugation and consequently breaks up in the molding process, the corrugated paperboard described above does not break up in the molding/stamping process and, instead, is able to be molded into a unitary structure. This ability to mold the corrugated paperboard into a unitary structure is specifically due to the high density of fluting in the corrugation.

In one preferred embodiment of the present invention, single-face corrugated paperboard comprising a flat outer layer and an internal contoured layer comprising a flute repeat length to flute height ratio of 2.6 is pressed and formed by introducing the single-face corrugated paperboard into a stamp and applying pressure and temperature for an amount of time such that the corrugated paperboard becomes pressed and formed to form a unitary container. The high frequency of flutes and ridges in the internal layer cause the single face paperboard to be stamped by this method to form a satisfactory unitary structure such as a container.

Reference is now made to FIG. 3 which is a stamp used in conjunction with the method for stamping the corrugated paper as shown. In an exemplary embodiment of the method, it is important that the paperboard be flexible and easily deformed without fracturing or cracking. Accordingly, in a first step moisture is added to the paperboard to soften the fibers. Moisture is added until the moisture level of each sheet is 8 to 11%, however, it is best to run as close to the lower end of this range in an exemplary embodiment to prevent excessive moisture forming steam beneath any coating applied to the paperboard in the forming process causing the coating to blister. However, the deeper the stamping the higher moisture content required. An additive such as fluorocarbon is added to the moistening process to achieve about a 1% solution in water. The additive assists in water retention, aids forming and reduces grease wicking in the final process.

The moisture and fluorocarbon applied to the paperboard does not immediately penetrate the sheet so that the sheet remains stiff and difficult to form at first. Additionally, latent moisture may still be laying on top of the sheet, having not been absorbed by the fibers, therefore in an exemplary embodiment, the paperboard sits for forty-eight to seventy-two hours before forming, allowing the board to reach equilibrium and to obtain a more uniform distribution of moisture throughout the cross-section of the sheet.

The paperboard is deep drawn utilizing a stamp, generally indicated as 100. The stamp includes a bolster plate 102 upon which is seated a heated female cavity 104. A plunger is slidably mounted on bolster plate 102 to move into and out of heated female cavity 104.

A top die mounting plate 108 slidably supports a reciprocating platen 110. Platen 110 is attached to a male die 112. Male die 112 moves towards and is received in heated female cavity 104 with the reciprocating motion of platen 110. A draw ring 114 is mounted about male die 112 for positing paperboard prior to stamping.

The method of pressing or stamping the paperboard consist of the basic steps of feeding the paperboard, creasing the paperboard, cutting the paperboard and forming the paperboard. The moistened paperboard is creased in an area where corners will be formed while the paperboard blank is formed in a web. The web is then advanced a predetermined amount centering the creased paperboard between male die 112 and heated female cavity 104. Reciprocating platen 110 pushes male die 112 through the die cavity 104, shearing the registered pre-creased paperboard from the remainder of the web and urging it to fall through the die creating the blank. The pre-creased cut blank falls through and is centered between male die 112 and draw ring 114 and heated female cavity 114 mounted on bolster plate 102.

Draw ring 114 is extended and contacts the paperboard, tensioning the paperboard as male die 112 descends pushing the paperboard into female cavity 104. The draw ring holds the board tightly against the rim of the female cavity to discourage wrinkles from forming on the side panels of the container as it is being drawn. The draw ring 114 further forces excess paper into the corners and insures that neat, even folds are made, following the pre-creased lines. The more tension applied to the paperboard during forming, the neater the folds and fewer wrinkles formed on the side panels.

Once all of the paperboard has been drawn into the heated cavity, the press extends the male die slightly, depressing the female cavity 104 and bolster plate 102 by 1/30 seconds of an inch holding the tray under pressure and heat. In an exemplary embodiment, the pressure applied is approximately four tons at 120° F. This allows the moisture in the board to turn into steam and escape through vents provided in the die, setting the paperboard in the shape of the die. Essentially, the folds in the corners are steam ironed into the form of the container, imparting a structural integrity to the container.

The stamp (press) is then opened and plunger 106 is activated entering female cavity 104 ejecting the container from the heated female cavity. The excess paper is then trimmed from the formed container.

Figure 4:
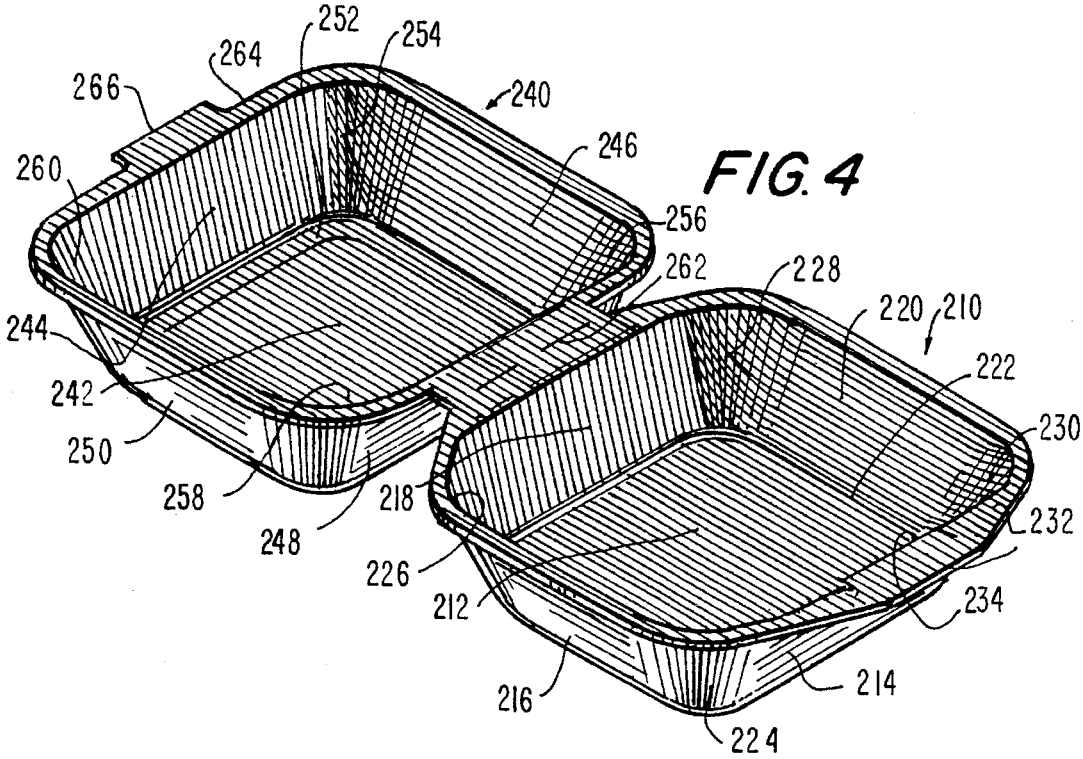
FIG. 4 is a perspective view of a container constructed in accordance with the invention.

FIG. 4 shows a corrugated paperboard container, generally indicated as 200, made by the stamping process of the present invention. The container has a clam shell construction and includes a lower compartment 210 for receiving food and the like and an upper compartment 240 for covering and closing the container. Lower compartment 210 includes a base 212 and four upstanding sidewalls 214, 216, 218 and 220, integrally formed with base 212 along fold line 222 formed during stamping. Wall 214 is coupled to wall 216 along a curve at connecting wall 224 formed during stamping. Similarly, wall 216 is coupled to wall 218 by a curved wall 226, wall 218 is coupled to wall 220 by curved wall 228 and curved wall 220 is formed integrally with front wall 214 by a curved wall 230. Each of curved walls 224, 226, 228, 230 are formed during stamping and easily could be formed as fold lines. Wall 214 is formed with a lip 232 at an acute angle with wall 214 and having slot 234 formed therein.

Upper compartment 240 is similar in construction to lower compartment 210 and includes a top wall 242 and side walls 244, 246, 248 and 250, each of walls 244, 246, 248 and 250 are coupled to top wall 242 along a fold line 252 formed during stamping. Side walls 244, 246, 248 and 250 are also integrally coupled, each adjacent sidewall by a respective curved wall 254, 256, 258 and 260. Side wall 248 of upper compartment 240 and side wall 218 of lower compartment 210 are pivotably coupled together by a hinge 262 formed as a fold line between lower compartment 210 and upper compartment 240 during the stamping process. Upper compartment 240 rotates about hinge 262 in the direction of arrow A to close container 200 upon itself.

Side wall 244 is also formed with a lip 264 having a tab 266 formed thereon. Tab 266 is received within slot 234 to fasten upper component 240 to lower component 210.

In a preferred embodiment, bottom compartment is formed with a receiving lip adapted to receive a lip about upper compartment 240 to further seal in a mating relationship, container 200.

As shown in FIG. 4, upper compartment 240 and lower compartment 210 are each formed from paperboard 10 including outer layer 12 to which is glued one contoured internal layer 14. Contoured interior layer 14 consists of flutes 16 which are formed by alternating upper 18 and lower 20 curved surfaces. In a preferred embodiment the ratio of flute repeat length to flute height is 2.6 or less. Upon gluing the lower curved surfaces 20 of the internal layer 14 to the inner surface of outer layer 20 ridges 24 and grooves 26 are formed on the outer surface of the internal layer 14.

The paperboard employed may be solid bleached sulfate (SBS) or chipboard, or a recycled material. In one embodiment, outer flat layer 12 may be chipboard, and internal layer 14 may be a recycled paperboard medium. In a preferred embodiment, the outer layer 12 has a thickness of 0.007 inches (7 points) and internal contoured layer 14 has a thickness of 0.040 inches (40 points). The two layers together may have a working range from 30 to 60 points from the outer surface of outer layer 12 to the ridged top of internal layer 14. As a result, less paperboard is used, the container is light in weight, and although the container maintains its strength and rigidity as if layers were solid paperboard, it, at the same time, possesses the capability of becoming stamped.

As shown, the internal surfaces of walls 212, 214, 216 and 218 as well as 242, 244, 246 and 258 of compartments 210 and 240 are formed with ridges having upper ridges 24 and grooves 26 between ridges 24. There are 6 to 12 ridges per inch, and, in a preferred embodiment, there are 9 ridges per inch. As shown more clearly in FIG. 4, the upper ridges 24 of bottom wall 212 form a raised food-receiving surface on which the food is placed. Any moisture given off by the hot food within the container is received and collected within grooves 26. In this manner, the collected moisture is not absorbed by the food, and container 200 prevents the food from becoming soggy.

In a preferred embodiment, internal layer 14 is coated with a water-based coating prior to stamping. The coating is repulpable, recyclable, and resists the penetration of moisture given off by the hot food. As a result, the molded paperboard container maintains its strength and rigidity.

Although the container formed by the process of this invention is shown to have a particular shape, it should be understood that the stamping process for corrugated paperboard can be used to form a corrugated container of any shape, such as round, square, rectangular or oval, as well as non-container structures such as trays or the like. Advantageously, as a result of the present invention, there is provided a method of stamping corrugated paperboard having an internal contoured layer containing a high frequency of flutes and a food container formed by the method of stamping corrugated paperboard, such food container being able to resist the penetration of moisture, is rigid and strong, is light in weight and collects moisture in troughs or grooves to prevent food from becoming soggy.

By forming paperboard having one layer consisting of 350 to 400 sets of flutes per linear meter of paperboard, a light weight container capable of being formed in a stamping process is provided. By utilizing such high frequency fluted paperboard, and by moistening the paperboard and holding the paper taut prior to pressing and by pressing at a high pressure and high temperature during the cycle, a unitary construction formed of corrugated paperboard is obtainable.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A method for molding a corrugated paperboard container having a first layer of flat paperboard to which is attached a second layer of contoured paperboard, said contoured layer having a plurality of flutes, each said flute including a first flute tip and a second flute tip, each flute having a flute rise, the flute rise being substantially vertical at the midpoint between said flute tips, said forming method comprising, providing moisture to said paperboard, placing said corrugated paperboard into a stamping die, said stamping die having a male die and a female cavity shaped in the shape in which the paperboard is to be formed; pressing said paperboard between said die and said cavity to apply a pressure to said paperboard; applying heat to said paperboard simultaneously with said application of pressure; and removing said die from said cavity; said paperboard having folds therein and said heat applied to said paperboard creating steam within said cavity to steam iron set folds to form a container and provide structural integrity.

2. The method of claim 1, wherein the flute repeat length to flute height ratio is 2.6.

3. The method of claim 1, wherein the first layer of paperboard has a thickness in the range of 0.3 mm to 1.5 mm.

4. The method of claim 1, wherein the contoured layer of paperboard has a thickness in the range of 0.23 mm to 0.5 mm.

5. The paperboard of claim 1, wherein the amount of moisture added is substantially within the range of 3% to 11% by weight.

6. The method of claim 1, further comprising the step of ejecting said paperboard from said cavity after said die has been removed.

7. The method of claim 1, wherein said stamping die includes a draw ring and further comprising the step of tensioning said paperboard while said paperboard is pressed between said die and said cavity.

8. The method of claim 1, wherein said pressure is substantially four tons.

9. The method of claim 1, wherein said heat is applied at a temperature of substantially 120° F.

10. A method for molding a corrugated paperboard container having a first layer of flat paperboard to which is attached a second layer of contoured paperboard, said contoured layer having a plurality of flutes, each said flute including a first flute tip and a second flute tip, each flute having a flute rise the flute rise being substantially vertical at the midpoint between said flute tips, the first layer of paperboard having a thickness in the range of 0.3 mm to 1.5 mm, and the contoured layer of paperboard having a thickness in the range of 0.23 mm to 0.5 mm, said forming method comprising; providing moisture to said paperboard, the amount of moisture added is substantially within the range of 3% to 11% by weight, said paperboard having folds; placing said corrugated paperboard into a stamping die, said stamping die having a male die and a female cavity shaped in the shape in which the paperboard is to be formed said stamping die including a draw ring; pressing said paperboard between said die and said cavity to apply substantially four tons of pressure to said paperboard; applying heat to said paperboard simultaneously with said application of pressure; said heat creating steam within said cavity to steam iron said folds to form container; tensioning said paperboard while said paperboard is pressed between said die and said cavity; removing said die from said cavity; and ejecting said paperboard from said cavity after said die has been removed.

11. The method of claims 10, wherein said plurality of flutes having a flute repeat length the flute repeat length height ratio is 2.6.

* * * * *